US009801455B2

(12) United States Patent
Christoff

(10) Patent No.: US 9,801,455 B2
(45) Date of Patent: Oct. 31, 2017

(54) APPARATUS AND METHODS FOR SECURING AND CONCEALING GUNS AND ACCESSORIES

(71) Applicant: Michael Christoff, Naples, FL (US)

(72) Inventor: Michael Christoff, Naples, FL (US)

( * ) Notice: Subject to any disclaimer, the term of this patent is extended or adjusted under 35 U.S.C. 154(b) by 472 days.

(21) Appl. No.: 14/139,361

(22) Filed: Dec. 23, 2013

(65) Prior Publication Data

US 2014/0183239 A1 Jul. 3, 2014

Related U.S. Application Data

(60) Provisional application No. 61/745,085, filed on Dec. 21, 2012.

(51) Int. Cl.

| | |
|---|---|
| ***F41C 33/02*** | (2006.01) |
| ***A45F 5/00*** | (2006.01) |
| ***F41C 33/04*** | (2006.01) |

(52) U.S. Cl.

CPC ..... *A45F 5/00* (2013.01); *F41C 33/0209* (2013.01); *F41C 33/041* (2013.01); *F41C 33/048* (2013.01); *A45F 2005/008* (2013.01); *A45F 2200/0591* (2013.01)

(58) Field of Classification Search

CPC ..... A45C 2011/002
USPC ..... 224/587, 219, 222–223, 250, 901, 911, 224/192–193, 198, 238, 243, 267
See application file for complete search history.

(56) References Cited

U.S. PATENT DOCUMENTS

| | | | | |
|---|---|---|---|---|
| 4,544,089 | A * | 10/1985 | Tabler | 224/192 |
| 4,775,374 | A * | 10/1988 | Cilento | A61F 5/443 604/338 |
| 5,392,975 | A * | 2/1995 | Blankenship, Jr. | 224/148.5 |
| 5,693,006 | A * | 12/1997 | Slautterback | A61F 5/028 2/48 |
| 6,076,715 | A * | 6/2000 | Easter | 224/149 |
| 8,857,681 | B2 * | 10/2014 | Burnett | A44B 11/005 224/197 |
| 2004/0084494 | A1 * | 5/2004 | Gilliam | 224/583 |
| 2004/0182896 | A1 * | 9/2004 | Ballard | A45F 3/14 224/222 |
| 2005/0133130 | A1 * | 6/2005 | Blum | A45F 5/00 150/149 |
| 2006/0011688 | A1 * | 1/2006 | Duncan | A45F 3/14 224/602 |
| 2006/0027615 | A1 * | 2/2006 | Masi | 224/222 |
| 2006/0156525 | A1 * | 7/2006 | Jenkins | F41C 33/0209 29/407.1 |
| 2006/0196907 | A1 * | 9/2006 | Pruitt | A45F 5/00 224/587 |
| 2006/0219743 | A1 * | 10/2006 | Gallagher | 224/192 |

(Continued)

*Primary Examiner* — Justin Larson
*Assistant Examiner* — Phillip Schmidt
(74) *Attorney, Agent, or Firm* — Patzik, Frank & Samotny Ltd.

(57) ABSTRACT

A number of apparatus, devices, and methods for securing and concealing handguns, handgun accessories and other accessories are disclosed. The devices can include one or more sticky surfaces for securing the handguns and accessories with garments or other devices. The devices can include containers or container portions for receiving a handgun or accessories and attachment portions for attaching the container or container portions to a garment, device, or object.

8 Claims, 7 Drawing Sheets

(56) References Cited

U.S. PATENT DOCUMENTS

| | | | | |
|---|---|---|---|---|
| 2006/0261107 | A1* | 11/2006 | Daniels | A45C 1/04 224/219 |
| 2008/0087695 | A1* | 4/2008 | Froelich | A45F 5/02 224/196 |
| 2009/0050658 | A1* | 2/2009 | Boyd et al. | 224/245 |
| 2010/0078100 | A1* | 4/2010 | Orton | 150/134 |
| 2012/0152990 | A1* | 6/2012 | Kulas | A45F 5/00 224/222 |
| 2013/0228601 | A1* | 9/2013 | Velarde | A45F 5/00 224/222 |
| 2014/0117064 | A1* | 5/2014 | Evans | 224/587 |

* cited by examiner

APPARATUS AND METHODS FOR SECURING AND CONCEALING GUNS AND ACCESSORIES

CROSS-REFERENCE TO RELATED APPLICATION

This application claims priority to U.S. provisional patent application No. 61/745,085, filed Dec. 21, 2012, which is hereby incorporated by reference in its entirety.

FIELD OF THE INVENTION

The instant disclosure relates to portable apparatus and devices for concealing and securing goods on a person. More specifically, the instant disclosure relates to containers for securing and concealing firearms, firearms accessories and other accessories.

BACKGROUND OF THE INVENTION

It is known to use a holster to carry a handgun. To safely carry the handgun, a traditional holster must be secured to the person carrying the gun in some way. In general, the holster must be attached to a belt, pants, vest, or other piece of clothing so that the handgun can be securely carried without being dropped and/or accidentally discharged. This rigid, generally non-adjustable attachment undesirably restricts the possible placement of the holster and does not allow the carrying individual to move the holster if he or she so desires. Furthermore, traditional holsters are limited in that they can only be coupled with a single garment or to a particular spot on the user's body.

There is therefore a need for an improved system, apparatus, and method for securely carrying and concealing firearms, firearms accessories and other accessories.

SUMMARY OF THE INVENTION

The present invention and disclosure discloses and provides a new and improved system, apparatus, and method for securing and concealing firearms or guns, firearms accessories and other accessories. An exemplary embodiment of such a system includes a container comprising an adjustable-size interior and an exterior comprising polyurethane rubber and an attachment device comprising a first polyurethane rubber surface for coupling with the container exterior and a second polyurethane rubber surface for coupling with a garment. In the preferred embodiment, the container is integral with the attachment device. In an embodiment, the attachment device is configured for coupling with the ankle or leg of a user, or with a vest.

BRIEF DESCRIPTION OF THE DRAWINGS

The preferred embodiments of the invention will be described in conjunction with the appended drawings, which illustrate and do not limit the invention, where like designations denote like elements, and in which.

DETAILED DESCRIPTION OF THE INVENTION

The following disclosure describes a number of apparatus, devices, and methods for securing and concealing guns, gun accessories and other accessories, for example, as ammunition magazines, pocket knives, and portable electronic devices. Several of the apparatus or devices have common features, such as, for example only, one or more "sticky" or tacky surfaces or "sticky" materials. Such sticky surfaces can comprise, for example only, a rubber, such as polyurethane rubber, or another material of moderate stickiness or tackiness. The same materials may be used for all sticky surfaces on a single apparatus or on multiple interacting apparatus, or different materials may be used for sticky surfaces on a single apparatus or for multiple interacting apparatus. The sticky material can be of an appropriate durometer (i.e., hardness), customized to a particular application. For many of the apparatus described herein, a relatively low durometer may be chosen to maintain high flexibility of the apparatus. Furthermore, the following disclosure describes securing or coupling devices and apparatus using one or more sticky or tacky surfaces. It should be understood that this relationship refers to a friction-based temporary coupling of apparatus or devices, rather than a permanent adhesion.

Figure 1:
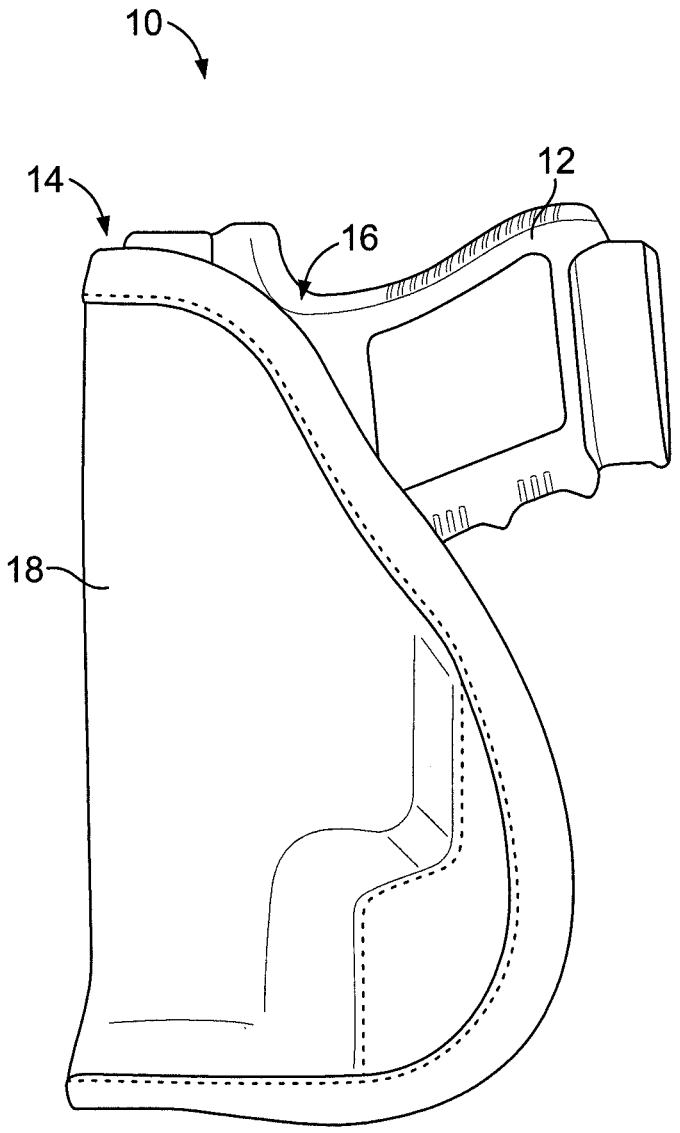
FIG. 1 is a side view of an exemplary embodiment of a container for a handgun, i.e., a holster.

FIG. 1 is an isometric side view of a container or holster 10 for carrying a handgun 12. The holster 10 improves on holsters known in the art by allowing the handgun 12 to be securely carried without requiring a rigid attachment between the holster 10 and a belt, pants, vest, or other piece of clothing, though such a rigid attachment may be accommodated.

The holster 10 will be described with reference to receiving, accommodating, and carrying handguns, but the holster 10 is not limited to such use. Instead, in embodiments, the holster 10 may be used to receive, accommodate, and/or carry additional or alternative objects and devices.

The holster 10 may comprise an interior 14 in which the handgun is disposed in FIG. 1, an opening 16 through which the handgun 12 or other objects can be inserted and removed, and an exterior 18. But for the opening 16, the interior 14 of the holster can be enclosed. The interior 14 can comprise materials and finishes appropriate for retaining a handgun 12, such as, for example and without limitation, woven nylon or a similar material. The materials and construction of both the interior 14 and exterior 18 of the holster 10 can be relatively flexible, so the size of the interior 14 may be adjustable (e.g., collapsible when empty).

The exterior 18 of the holster 10 may comprise one or more materials that are slightly sticky or tacky. In the embodiment shown in FIG. 1, substantially all of the exterior 18 of the holster 10 may include a sticky material. However, in other embodiments, a greater or lesser amount of sticky material may be included on the exterior 18. For example, in an embodiment, a first side of the exterior 18 may comprise a sticky material, while a second side of the exterior 18 may comprise a non-sticky material.

The size and shape of the exterior 18 and interior 14 of the holster 10 can be designed and manufactured to suit the needs of a particular application, i.e., a particular handgun or other object. Accordingly, the holster 10 is not limited to a particular size or shape. In an embodiment, the holster 10 may be configured to in size and shape to accommodate a wide range of devices (e.g., different handgun models).

The stickiness of the exterior 18 of the holster 10 allows it to be securely carried in a pocket or waistband of a user without the need for a rigid attachment to a belt, pants, or other article of clothing. As a result, the holster 10 can be secured within a chosen area of the waistband of a user, removed, and replaced for the comfort of the user. Further, the holster 10 can collapse when the user removes the handgun 12, allowing the user to move more freely with the handgun 12 removed from the holster 10 or otherwise drawn.

Figure 2:
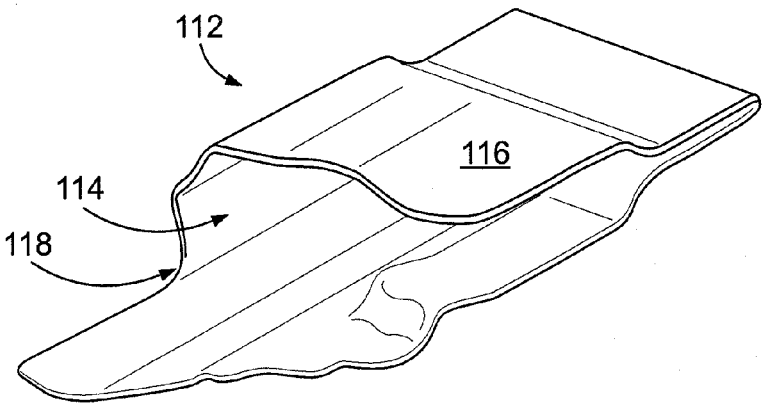
FIG. 2 is an isometric view of an exemplary embodiment of an insert that may find use with the container of FIG. 1.

In an embodiment, the holster 10 may be used in conjunction with an insert. FIG. 2 is an isometric view of an exemplary embodiment of an insert 112 that may be used with the holster 10. Referring to FIGS. 1 and 2, the insert 112 may include an interior 114, an exterior 116, and an opening 118 through which a handgun and/or other object may be inserted and removed. The exterior 116 of the insert 112 may be configured in size and shape to fit within the interior 14 of the holster 10. The interior 114 of the insert 112 may be configured to in size and shape to hold a handgun and/or other object. The insert may comprise one or more materials including thermoplastics, such as KYDEX (an acrylic-polyvinyl chloride material), commercially available from Kydex, Inc., one or more polymers, one or more metals, etc.

In an embodiment, the holster 10 and insert 112 may be used together to provide an apparatus specifically configured for a particular handgun. For example, in an embodiment, the same holster 10 may accommodate a wide variety of handguns, but the insert 112 (e.g., the interior 114 of the insert 112) may be specifically configured in size and shape to receive a particular handgun shape or model.

Although the holster 10 provides a safe and effective means of carrying a handgun 12 and/or other object in the user's waistband, pocket, or otherwise, additional devices may be desirable for carrying a handgun 12 on different parts of the body (e.g., the leg or chest) and/or for carrying additional or other objects (e.g., a backup handgun, an ammunition clip, pocket knife, flashlight, or cellular telephone).

Figure 3A:
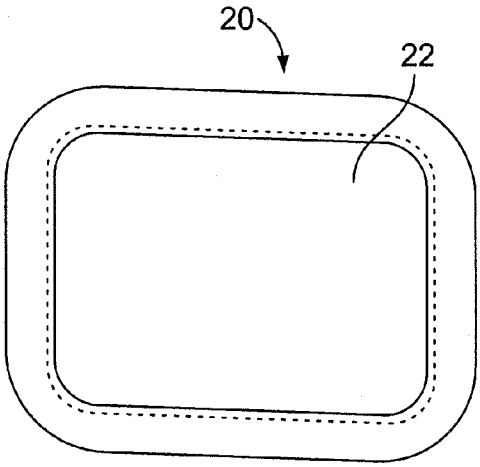
FIGS. 3A-3C are isometric views of an exemplary embodiment of an attachment device for coupling a container with a vest or other article of clothing.
Figure 3B:
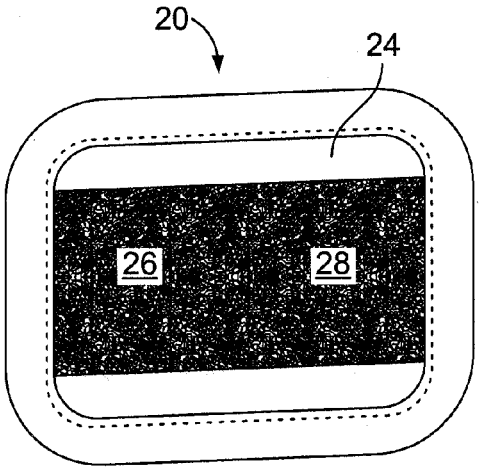
Figure 3C:
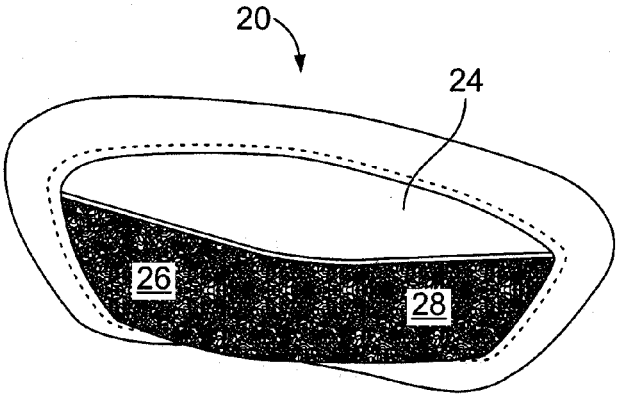

FIGS. 3A-3C are isometric views of an attachment device 20 for coupling a container, such as the holster 10 shown in FIG. 1, with a vest, other garment, or other object. The attachment device 20 shown in FIGS. 3A-3C may be referred to herein as a BUG (BackUp Gun) pad 20 for ease of description. However, the BUG pad 20 is not limited to use with a handgun, and instead may find use with numerous additional or alternative objects and devices. The BUG pad 20 may comprise an inward side 22, an outward side 24, and a retention strap 26. The inward side 22 can comprise a sticky material that can assist with securing a container in place, such as the holster 10 described in conjunction with FIG. 1, for example only. Both the inward side and outward side can include an outer border coupled to the BUG pad 20 by stitching or another appropriate attachment mechanism known in the art.

The outward side 24 of the BUG pad 20 can comprise a sticky surface spanned by the retention strap 26. The retention strap 26 and outward side sticky surface can be, alone and/or in conjunction, configured to secure the BUG pad 20 in place on, for example only and without limitation, a strap of a tactical vest or other garment. The retention strap 26 can be attached at two ends to the outward side 24, for example, but may remain separable from the outward side 24 along the majority of its length (see for example FIG. 3C). The retention strap 26 can also include a fastener 28 such as, for example only, one half of a hook-and-loop fastener (i.e., the "hooks" or the "loops") or another type of fastener for coupling with a garment or other object. Accordingly, a tactical vest strap or other garment may be secured between the retention strap 26 and the sticky surface of the outward side 24. Additionally or alternatively, the retention strap fastener 28 can be secured to a garment or other object, such as, for example, a fastener on the garment or other object.

A user of the BUG pad 20 may secure the BUG pad 20 to a garment such as, for example only, a strap of a tactical vest, as described above. When secured, the inward side 22 of the BUG pad 20 may face the user's body. The user may then place an object or container such as, for example only, the holster 10, between the BUG pad 20 and the user's body. The sticky surface of the inward side 22 of the BUG pad 20 may meet and stick to a sticky surface or other feature of the object or container to hold the object or container in place.

Figure 4A:
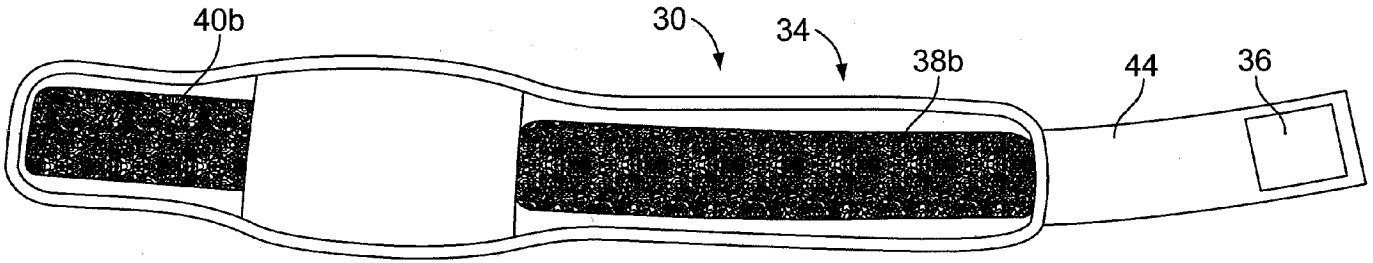
FIGS. 4A-4C are isometric views of an exemplary embodiment of an attachment device for coupling a container with an ankle or leg of a user.
Figure 4B:
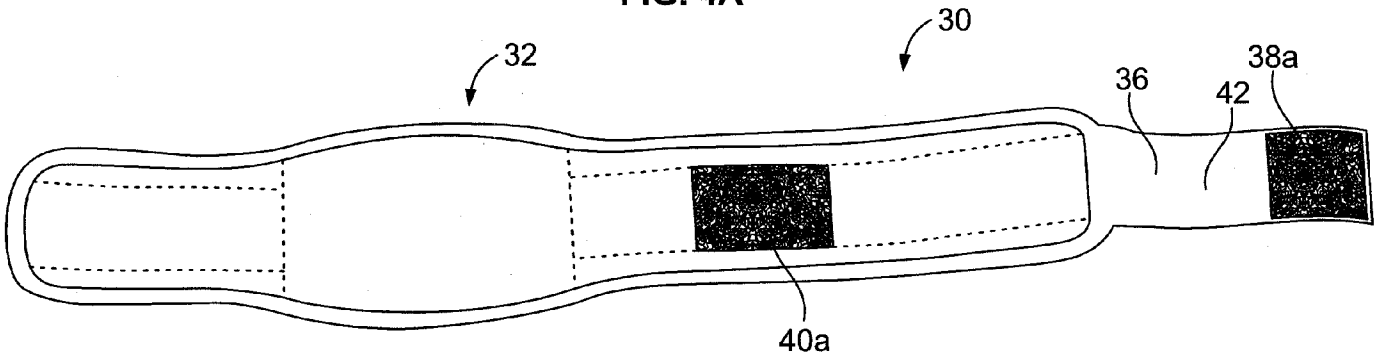
Figure 4C:
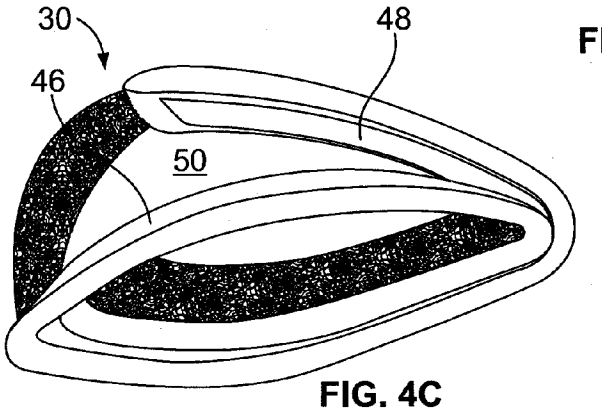

FIGS. 4A-4C are isometric views of an attachment device 30 for coupling a container, such as the holster 10, or another object including, but not limited to, a handgun, with an ankle or leg of a user. The attachment device 30 of FIGS. 4A-4C will be referred to herein as an ankle attachment device 30 for ease of reference only, but is not limited to attachment with an ankle. Similarly, the ankle attachment device 30 will be described with reference to the ankle of a user for ease of description, but is not limited to such use. Instead, the ankle attachment device 30 can be used with the ankle, leg, or other portion of a user's body, or with some other object.

The ankle attachment device 30 may comprise an inward side 32, an outward side 34, and a fastener extension 36 having an outer loop fastener 38*a*. Both the inward side 32 and the outward side 34 can include an outer border coupled to the body of the ankle attachment device 30 by stitching or another appropriate coupling mechanism known in the art. The inward side 32 can include one or more sticky surfaces and an inner loop fastener 40*a*. The inner loop fastener 40*a* can be, for example, one half of a hook-and-loop fastener, or another appropriate adhesive or fastener known in the art. The inner loop fastener 40*a* can be configured to be coupled with an inner loop fastener 40*b* on the inward side 32 of the ankle attachment device 30 to secure the ankle attachment device 30 around an ankle of a user.

The outward side 34 of the ankle attachment device can also include a sticky surface, an inner loop fastener 40*b*, and an outer loop fastener 38*b*. The inner loop fastener 40*b* can be configured for coupling with the inner loop fastener 40*a* on the inward side 32 of the ankle attachment device 30 for creating an inner loop and securing the ankle attachment device 30 to an ankle of a user, for example. The outer loop fastener 38*b* on the outward side 34 of the ankle attachment device 30 can be configured for coupling with the outer loop fastener 38*a* on the fastener extension 36.

The fastener extension 36, like the ankle attachment device 30 itself, can have an inward side 42 and an outward side 44. The inward side 42 of the fastener extension 36 can include an outer loop fastener 38*a* such as, for example only, half of a hook-and-loop fastener for coupling with an outer loop fastener 38*b* on the outward side 34 of the ankle attachment device 30. By coupling the outer loop fasteners 38*a*, 38*b* with each other, the fastener extension 36 can be secured to the outward side 34 of the ankle attachment device 30 for creating an outer loop around an ankle or leg such that a handgun, handgun accessory or other accessory can be carried in the ankle attachment device 30 between the inner loop and outer loop, as further described below. The fastener extension 36 may be of an appropriate length, elasticity, and flexibility for securely tightening the ankle attachment device to the ankle or leg of a user.

FIG. 4C is an isometric view of the ankle attachment device 30 in a multi-loop closed configuration in which the ankle attachment device 30 can be secured to an ankle of a user, in an embodiment. In the multi-loop configuration shown, an inner loop 46 is provided for receiving the leg or ankle of a user, and an outer loop 48 is provided around the inner loop, with a pocket 50 between the loops. A respective sticky surface of the outward and inward sides 34, 32 of the ankle attachment device 30 coincide with the pocket 50, such that a holster, handgun, or accessory can be placed in the pocket 50 to be secured by the sticky surfaces of the ankle attachment device 30 and/or by tightening the pocket 50 around the object to be secured.

Figure 4D:
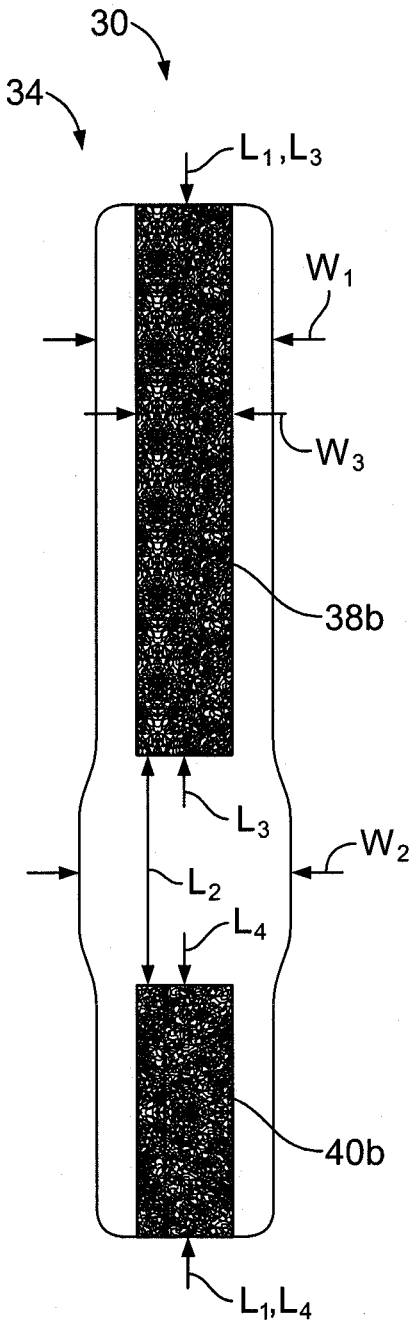
FIGS. 4D-4E are partial end views of an embodiment of the attachment device of FIGS. 4A-4C.

FIG. 4D is a partial schematic views of an embodiment of the ankle attachment device 30 illustrating, among other things, dimensions of an exemplary embodiment of the ankle attachment device 30. Of course, dimensions other than those explicitly disclosed are possible and contemplated. The fastener extension 36 is omitted from FIG. 4D for clarity of illustration. The ankle attachment device may have a width $W_1$ of about 3⅛ inches along a substantial portion of its length, and may have an expanded width portion with a width $W_2$ of about 4⅜ inches, in an embodiment. The expanded width portion may have a length $L_2$ of about 9½ inches, and the entire ankle attachment device 30 (not including the fastener extension 36) may have a length $L_1$ of about 23½ inches, in an embodiment. The expanded width portion may comprise a sticky surface configured to be coincident with the pocket 50 between an inner loop 46 and an outer loop 48, as shown in FIG. 3C. The outer loop fastener 38*b* on the outward side 34 of the ankle attachment device may have a length $L_3$ of about 12 inches and a width $W_3$ of about 2 inches, in an embodiment. The inner loop fastener 40*b* in the outward side 34 may have a length $L_4$ of about 6 inches and a width $W_4$ of about 2 inches, in an embodiment.

Figure 4E:
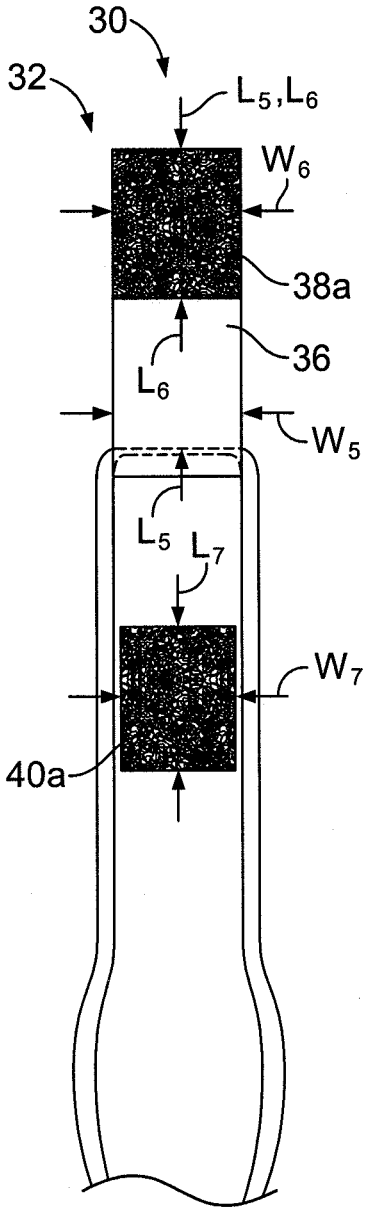

FIG. 4E is a partial schematic view of the embodiment of the ankle attachment device 30 illustrated in FIG. 4D, with a portion of the body of the ankle attachment device 30 omitted for clarity of illustration. As shown in FIG. 4E, the fastener extension 36 can extend from the ankle attachment device 30 by a length $L_5$ of about 6¾ inches, with a width $W_5$ of about 2 inches, in an embodiment. The outer loop fastener 38*a* on the fastener extension 36 can have a length $L_6$ of about 3¼ inches, and a width $W_6$ of about 2 inches, in an embodiment. The inner loop fastener 40*a* on the inward side 32 can have a length $L_7$ of about 3 inches, and a width $W_7$ of about 2 inches, in an embodiment. The border surrounding the body of the ankle attachment device 30 can have a total length of about 53 inches, in an embodiment.

In operation, the ankle attachment device 30 may be wrapped around an ankle of a user or other object to secure a handgun, handgun accessory or other accessory to that user or object. The inner loop 46 of the ankle attachment device 30 may be formed by placing the inward side 32 of the ankle attachment device 30 against the user's ankle and wrapping the ankle attachment device 30 around the ankle until the inner loop fasteners 40*a*, 40*b* meet and are coupled together. The ankle attachment device 30 can be further wrapped around the ankle until the outer loop fasteners 38*a*, 38*b* meet and are coupled together. The user can position the ankle attachment device 30 such that the sticky surface on the outward side 34 is positioned where the user wants a handgun or accessory carried (e.g., on the outside of the ankle, on the inside of the ankle, etc.).

Figure 5A:
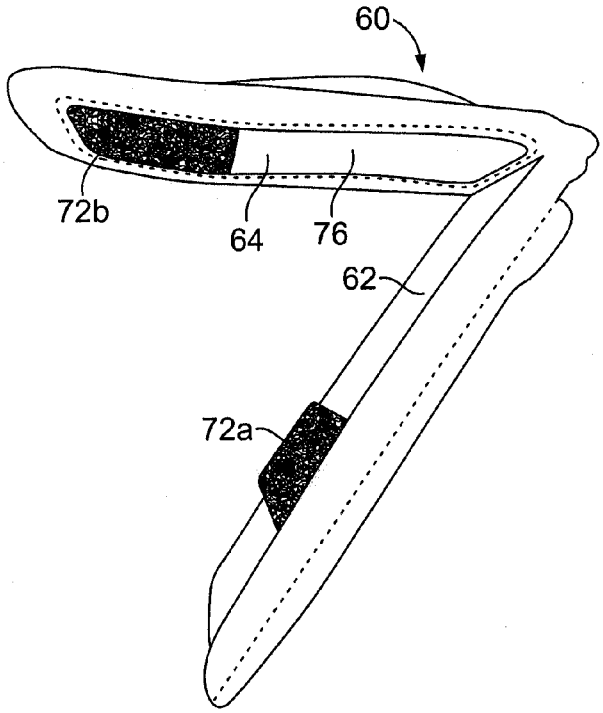
FIGS. 5A-5B are isometric views of an exemplary embodiment of an integrated container and attachment device for carrying, for example, an ammunition magazine.
Figure 5B:
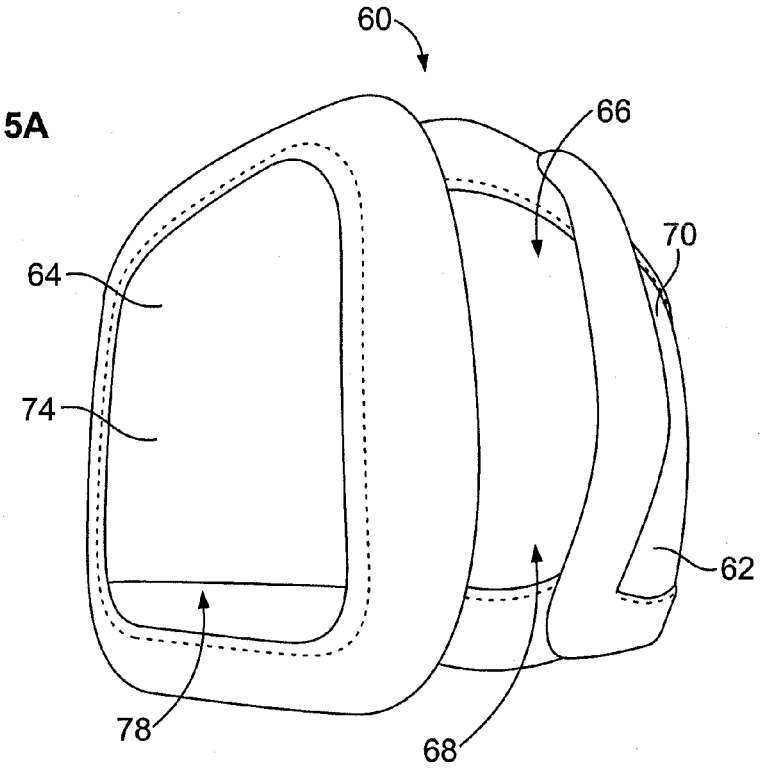

FIGS. 5A-5B are isometric views of an embodiment of an integrated container and attachment device for carrying, for example, an ammunition magazine, pocket knife, flashlight, cell phones, small electronic devices or other accessory, which may be referred to herein as an "accessory pouch" 60. The accessory pouch 60 can include a container portion 62 for receiving one or more accessories and an attachment portion 64 for coupling the container portion 62 with a belt, pants, other garment, or other object.

The container portion 62 of the accessory pouch 60 can include an interior 66 configured to receive one or more accessories, an opening 68 through which the accessories can be inserted and removed, and an exterior 70. But for the opening 68, the interior 66 of the container portion 62 can be enclosed. The interior 66 can include materials and finishes appropriate for retaining the accessories noted above (e.g., ammunition magazine, pocket knife, flashlight, cell phones, small electronic devices or other accessory) such as, for example, woven nylon or a similar material. The materials and construction of both the interior 66 and exterior 70 of the container portion 62 can be relatively flexible, so that the size of the interior 66 is adjustable (e.g., collapsible when empty).

The exterior 70 of the container portion 62 can comprise one or more sticky or tacky surfaces or materials and a border coupled to the exterior 70 by, for example, stitching or another appropriate attachment mechanism known in the art. In the embodiment shown, substantially all of the exterior 70 of the container portion 62 comprises a sticky surface. The stickiness of the exterior 70 may enable the accessory pouch 60 to be securely carried in a pocket of a user, for example and without limitation, without the need for a rigid attachment to a belt, pants, or other article of clothing. The exterior 70 of the container portion 62 can also include a fastener 72*a* such as, for example only, half of a hook-and-loop fastener for coupling with the attachment portion 64 of the accessory pouch.

The attachment portion 64 is provided for, among other things, coupling the container portion 62 with a belt, pants, other garment, or other object. The attachment portion 64 has an outer surface 74, an inner surface 76, and a pocket 78. The outer surface 74 and inner surface 76 may both comprise a sticky material and a border similar to the border of the exterior 70 of the container portion 62. The inner surface 76 may further include a fastener 72*b* such as, for example only, half of a hook-and-loop fastener for coupling with the fastener 72*a* on the container portion 62. The attachment portion pocket 78 can be configured to receive and store credit cards, business cards, identification, permits, and/or other accessories.

The accessory pouch 60 can be carried securely in a pocket, for example only, because of the sticky surface on the exterior 70 of the container portion and on the outer surface 74 of the attachment portion 64. The accessory pouch 60 can also be coupled to a belt or other garment by threading the belt through a space between the attachment portion 64 and the container portion 62 (see for example FIG. 5A) and coupling the fasteners 72*a*, 72*b* to each other.

In yet another alternative for securing the accessory pouch 60, the attachment portion 64 can be tucked into a pocket, pants, or other garment, and the container portion 62 can remain on the exterior of the garment, or vice-versa. In the uses described herein, the various sticky surfaces of the accessory pouch 60 may create a substantial amount of friction with each other and with one or more garments or other objects to securely hold the accessory pouch 60 in place.

Figure 6A:
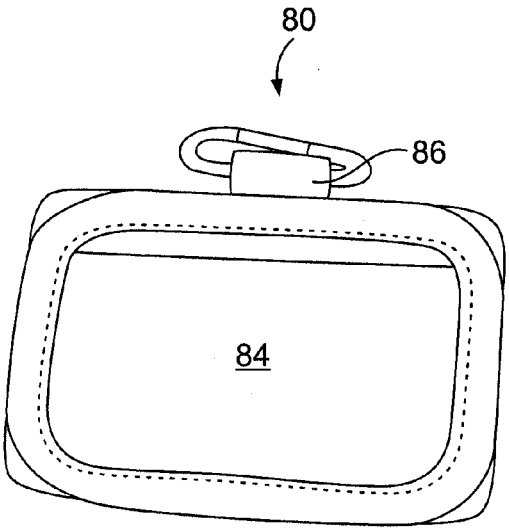
FIGS. 6A-6E are isometric views of an exemplary embodiment of an integrated container and attachment device for carrying, for example, a portable electronic device, such as a cellular telephone.
Figure 6B:
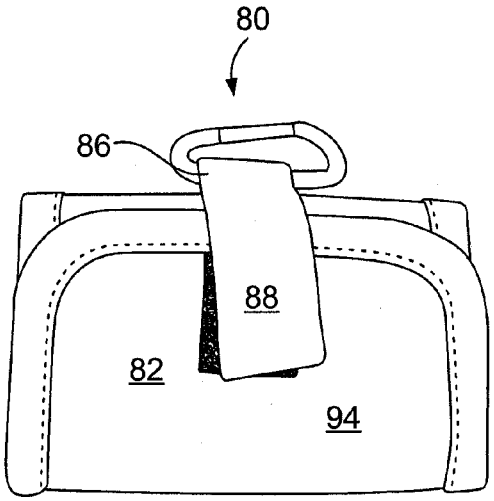

FIGS. 6A-6E are isometric views of an integrated container and attachment device for carrying, for example, a portable electronic device, such as a cellular telephone, as well as other accessories, such as credit cards, identification (e.g., a driver's license), cash, and the like, which may be referred to herein as a cell phone wallet 80 for ease of description purposes, but is not so limited in its use. In FIGS. 6A-6B, the cell phone wallet 80 is shown in a closed position. The cell phone wallet 80 can include a container portion 82 for receiving one or more accessories, an attachment portion 84 for coupling the container portion 82 with a belt, pants, other garment, or other object, a clip sleeve 86 for receiving a caribiner clip and the like, and a fastener extension 88.

Figure 6C:
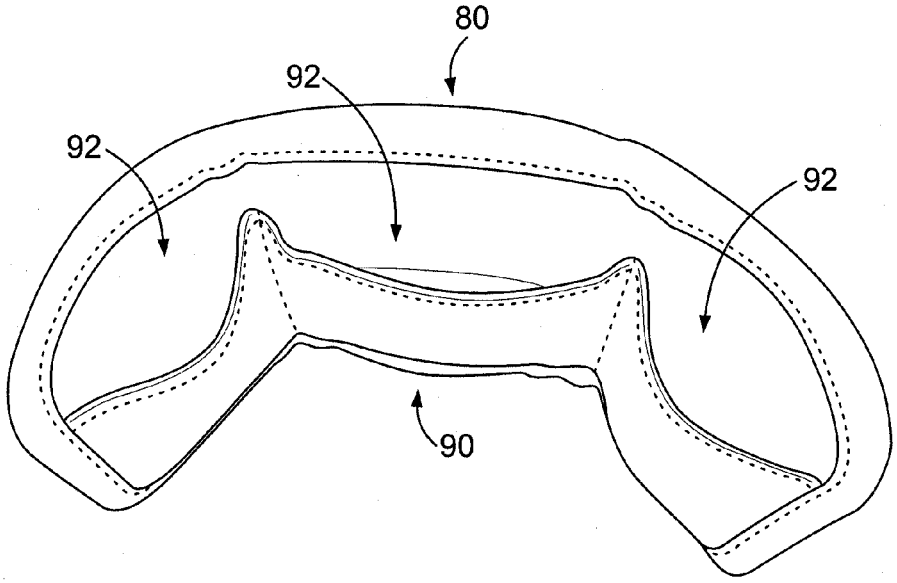

FIG. 6C is an isometric view of the cell phone wallet container portion 82 in an open position. The cell phone wallet container portion 82 can include an interior 90 having a number of pockets 92 for receiving portable electronic devices and/or other accessories, as noted above, and an exterior 94. The interior 90 can include materials and finishes appropriate for retaining the accessories noted above (e.g., portable electronic devices, credit cards, identification, cash, and the like) such as, for example, woven nylon or a similar material. The materials and construction of both the interior 90 and exterior 94 of the container portion 82 can be relatively flexible, so that the size of the interior 90 is adjustable (e.g., collapsible when empty).

Figure 6D:
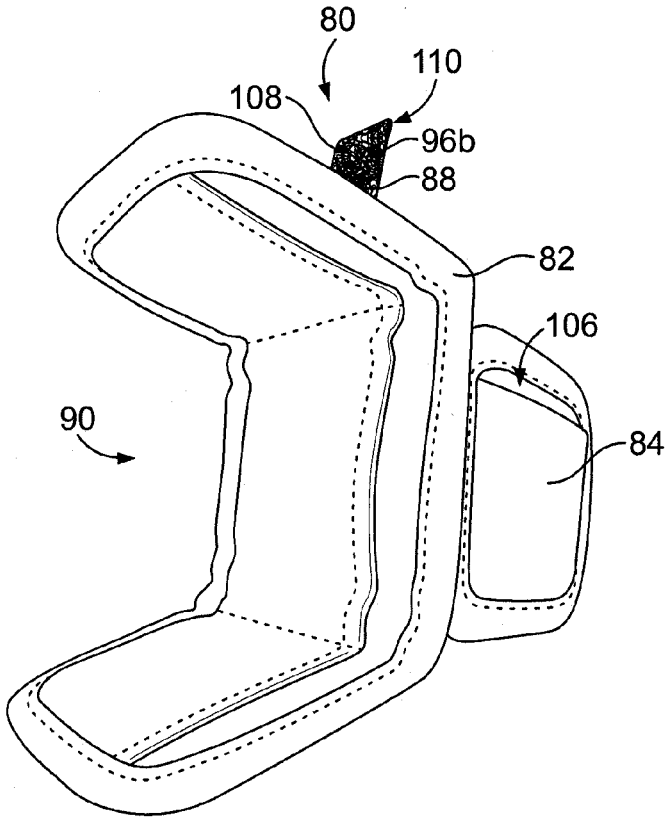
Figure 6E:
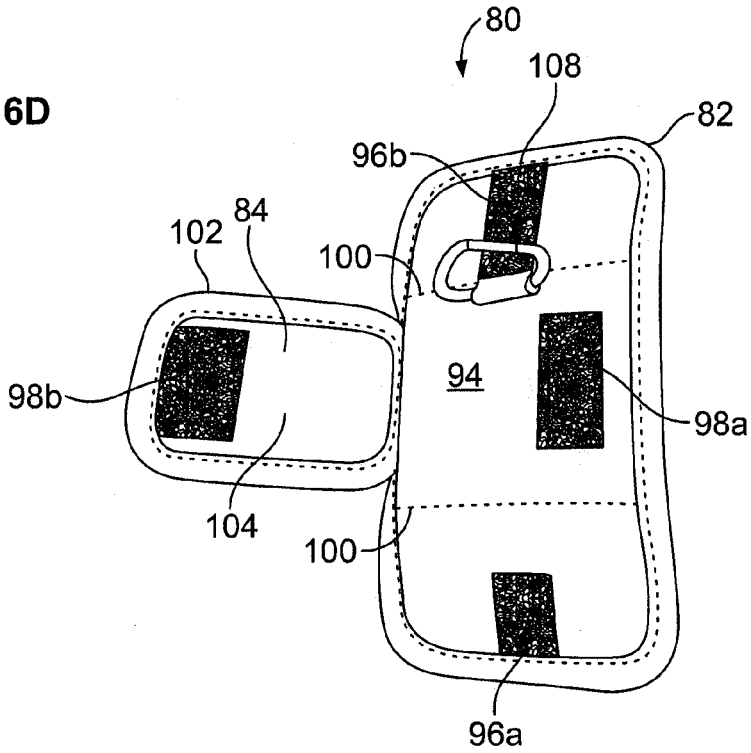

FIGS. 6D-6E are isometric views of the cell phone wallet 80 in an open position. The cell phone wallet container portion 82 can, as briefly noted above, also include an exterior 94 comprising, in an embodiment, one or more sticky materials or surfaces. In the embodiment shown, substantially all of the exterior 94 of the container portion 82 comprises a sticky material. The stickiness of the exterior 94 of the container portion 82 may enable the cell phone wallet 80 to be securely carried in a pocket of a user, for example and without limitation, without the need for a rigid attachment to a belt, pants, or other article of clothing. The exterior 94 of the container portion 82 can also include a closing fastener 96*a* and an attachment fastener 98*a*. The fasteners 96*a*, 98*a* can be, for example only, half of a hook-and-loop fastener.

In an embodiment, the container portion exterior 94 can include two seams 100 along which the container portion 82 can fold to allow the container portion 82 to collapse to a closed position such as, for example only, a tri-fold arrangement, as shown in FIGS. 6A and 6B. Of course, more or fewer seams 100 may be provided in other embodiments.

The cell phone wallet attachment portion 84 can be provided for, among other things, coupling the container portion 82 with a belt, pants, other garment, or other object. The attachment portion 84 can have an outer surface 102, an inner surface 104, and a pocket 106. The outer surface 102 and inner surface 104 may both comprise a sticky surface or material. The inner surface 104 may further include an attachment fastener 98*b* such as, for example only, half of a hook-and-loop fastener for coupling with the attachment fastener 98*a* of the container portion 82. The attachment portion pocket 106 can be configured to receive credit cards, business cards, identification, permits, and/or other accessories.

The cell phone wallet fastener extension 88 can have an inward side 108 and an outward side 110. The inward side 108 can include a closing fastener 96*b* such as, for example only, half of a hook-and-loop fastener for coupling with the closing fastener 96*a* on the container portion 82 to secure the container portion in a closed position, as shown in FIGS. 4A and 4B. The fastener extension 88 may be of an appropriate length, elasticity, and flexibility for securing the container portion 82 in a collapsed position.

Although a number of embodiments of this invention have been described above with a certain degree of particularity, those skilled in the art could make numerous alterations to the disclosed embodiments without departing from the spirit or scope of this invention. For example, all joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A system comprising:

a container comprising an adjustable-size interior and an exterior comprising a sticky rubber surface, said sticky rubber surface incapable of adhesion to human skin or clothing; and an attachment device comprising a first sticky rubber surface, said first sticky rubber surface incapable of adhesion to human skin or clothing and said first sticky rubber surface configured to be friction-based temporarily coupled with said container exterior and a second sticky rubber surface, said second sticky rubber surface incapable of adhesion to human skin or clothing and said second sticky rubber surface configured to be friction-based temporarily coupled with a garment.

2. The system of claim 1, wherein said container is integral with said attachment device.

3. The system of claim 1, wherein said container is configured to receive a handgun.

4. The system of claim 3, wherein said attachment device is configured to wrap around an ankle.

5. The system of claim 3, wherein said attachment device is configured to couple with a vest.

6. The system of claim 1, wherein the attachment device and container comprise complementary hook-and-loop fasteners.

7. The system of claim 1, wherein the attachment device further comprises a pocket configured in size and shape to hold a standard size credit card.

8. The system of claim 7, wherein the container is configured in size and shape to receive a mobile phone.

* * * * *